US005911562A

United States Patent [19]

Murphy et al.

[11] Patent Number: 5,911,562

[45] Date of Patent: Jun. 15, 1999

[54] HIGH PRESSURE FLUID DELIVERY SYSTEM WITH AUTOMATIC PRIMING VALVE

[75] Inventors: Edward P. Murphy, Blaine; Jeffrey M. Youngquist, Maplewood, both of Minn.

[73] Assignee: Hypro Corporation, St. Paul, Minn.

[21] Appl. No.: 08/681,924

[22] Filed: Jul. 29, 1996

[51] Int. Cl.[6] ..... F04B 49/02

[52] U.S. Cl. ..... 417/299; 417/279; 417/440; 137/517; 137/542

[58] Field of Search ..... 417/299, 440; 137/517, 542

[56] References Cited

U.S. PATENT DOCUMENTS

| | | | |
|---|---|---|---|
| 934,286 | 9/1909 | Cole | 137/517 |
| 1,879,136 | 9/1932 | Dubrovin | 417/440 |
| 2,845,945 | 8/1958 | Mancusi, Jr. | 137/469 |
| 4,168,723 | 9/1979 | Schneider | 137/542 |
| 4,182,354 | 1/1980 | Bergstedt | 137/10 |
| 4,498,372 | 2/1985 | Pareja | 92/187 |

*Primary Examiner*—Timothy S. Thorpe
*Assistant Examiner*—Ehud Gartenberg
*Attorney, Agent, or Firm*—Nikolai, Mersereau & Dietz, P.A.

[57] ABSTRACT

An improved valve assembly for automatically priming a hydraulic pump during a suction-fed application wherein the pump must draw fluid from within a holding tank for subsequent pressurization and transmission by the pump. The valve assembly of the present invention is provided in fluid communication with the outlet line of the pump and is capable of sensing the difference between fluid and air such that the air disposed within the pump at start-up may be quickly and efficiently bled from the system before the valve automatically closes once the fluid has been drawn into the pump in an amount sufficient to bring the pump into a fully primed condition. The valve assembly includes a housing member, a poppet member, a biasing means, and sealing means. The housing member includes a bore extending between an inlet aperture and an outlet aperture, and a slotted shoulder member extending radially inward from the inlet aperture. The biasing means biases the poppet member between a priming mode, wherein the poppet member is disposed in contact with the shoulder member such that a path of fluid communication extends from the slots of the shoulder member to the outlet aperture, and a closed mode, wherein the poppet member is disposed in contact with the sealing means such that the aforementioned path of fluid communication is closed.

2 Claims, 6 Drawing Sheets

HIGH PRESSURE FLUID DELIVERY SYSTEM WITH AUTOMATIC PRIMING VALVE

BACKGROUND OF THE INVENTION

I. Field of the Invention

The present invention relates generally to the field of high pressure hydraulic pumping applications. More particularly, the present invention relates to an improved valve assembly for automatically priming a hydraulic pump during a suction-fed application wherein the pump must draw fluid from within a holding tank for subsequent pressurization and transmission by the pump. The valve assembly of the present invention is provided in fluid communication with the outlet line of the pump and offers a path of least resistance for the air within the pump and the suction hose before automatically shutting off when fluid has been drawn into the pump.

II. Discussion of the Prior Art

The first step in initiating hydraulic pumping operations entails priming the pump to introduce fluid into the various pumping cylinders therewithin such that the fluid may be subsequently propagated away from the pump. Perhaps the most routine and least burdensome approach to priming hydraulic pumps involves supplying water to the pump in a pressure-fed fashion, wherein pressurized fluid is fed directly into the inlet line of the pump. In most pumping applications, pressurized water is produced by public water utilities which typically provide water lines carrying water pressurized to between 40 and 60 pounds per square inch (psi). The pressurized fluid works to supplement the suction force generated within the pumping cylinders to thereby collectively displace all the air from within the pump. Supplementing the suction force of the pump with pressurized water is advantageous in that, with these combined forces, the pump does not have to work as hard to draw the fluid into the internally disposed pumping cylinders.

However, not all pumping applications allow for the introduction of pressurized fluid into the inlet line of the particular hydraulic pump. For example, in the interest of isolating the public water supply from high pressure pumping operations, Japanese law requires that a holding tank be provided in between the public water line and the inlet line of the pump. Such an arrangement is shown in FIG. 1, wherein a hydraulic pump 10 is provided in combination with a suction hose 12, a holding tank 14, an unloader valve 16, a connecting hose 18, and a spray gun 20 for engaging in a high pressure spraying application. The suction hose 12 has a first end connected to the inlet port of the pump 10 and a second end which extends below the water line within the holding tank 14. The spray gun 20 is provided with a nozzle 22 of reduced diameter for producing back pressures of up to 3000 pounds per square inch or higher within the connecting hose 18. In this arrangement, the pressurized water from the public water supply is not capable of supplementing the suction force of the pump 10 which, in turn, causes the pump 10 to bear the entire burden of drawing water into the pumping cylinders to displace the air within the pump 10 for priming purposes. While this is effective in isolating the public water supply from potential contamination, several substantial drawbacks stem from the requirement of having a holding tank in between the public water supply and the pump.

The first notable disadvantage to restricting a hydraulic pump to such a suction-fed arrangement is that it is very difficult for the pump 10 to create enough suction force to draw water from the holding tank 14 to displace the air within the pump 10. The first reason for this stems from the substantial volume of air that exists within a high pressure pumping system prior to start-up. When the pump 10 is initially started, the entire pumping system is filled with air, including the pump 10 and all components connected both upstream and the downstream therefrom. The upstream line includes the suction hose 12 from the holding tank 14 to the inlet port of the pump 10, while the downstream line includes the unloader valve 16, the connecting hose 18, and the spray gun 20. In order to prime the pump 10, it is necessary to draw water into both the upstream line (suction hose 12) and the pump 10 in an amount sufficient to displace all of the air therefrom. However, the volume of air within the downstream line presents a substantial amount of resistance for the pump 10 when it attempts to draw water from the holding tank 14 to displace the air from the suction hose 12 and the pump 10. This is because the connecting hose 18 is typically quite long and of small diameter. There is also a substantial amount of resistance within the downstream line because the trigger of the spray gun 20 is typically off at start-up such that the nozzle 22 is closed, thereby providing no escape outlet for the volume of air trapped within the unloader valve 16, the connecting hose 18, and the spray gun 20.

The difficulty in priming hydraulic pumps during suction-fed applications also stems from the high operating speeds of hydraulic pumps, as well as the relatively small displacement of each cylinder within hydraulic pumps. Hydraulic pumps typically run at speeds ranging from 3400 to 3600 revolutions per minute depending upon the particular the motor/engine employed, while the displacement of each particular cylinder within the pump is typically quite small, in the order of a fraction of a cubic centimeter per cylinder for each pumping stroke. As such, the displacement during each pump stroke is so small that the pump 10 is incapable of developing a collective suction force sufficient to draw the air out of the suction hose 12 and pump 10 in order to pull water into the pump 10 for priming purposes. This lack of suction power, taken in conjunction with the air trapped within the unloader valve 16, the connecting hose 18, and the spray gun 20, causes the task of priming suction-fed hydraulic pumps to take an extremely long time to achieve. For example, priming periods of up to 20 minutes have been experienced using the system illustrated in FIG. 1. During this time, the pumps are subjected to increased stress and heating due to the "dry" pumping with no fluid within the cylinders, thereby decreasing the effective life span of the particular pumps. In many instances, the pumps are totally incapable of achieving a fully primed condition such that the pumps suffer seal damage from overheating.

One approach at lessening the time required to prime and minimizing the likelihood of damaging the pump involves manually triggering the spray gun 20 at start-up so that the air trapped within the downstream line may escape through the nozzle 22 thereof.

However, this method is disadvantageous in that it presents added difficulty to the process of priming the hydraulic pump 10 by requiring a user to manually activate the trigger of the spray gun 20 to open the nozzle 22. Frequent triggering of the spray gun 20 is also disadvantageous in that it increases the time required to bring the pump 10 into a fully primed condition with the suction hose 12 and the pump 10 completely filled with water.

A problem also exists with the aforementioned suction-fed hydraulic pumping applications after the pump 10 has been primed in that a certain amount of undesirable heating occurs within the pump head when the unloader valve 16 is activated. As noted above, the unloader valve 16 acts to reduce the pressure within the pump head when the trigger of the spray gun 20 is released while maintaining the water within the connecting hose 18 and spray gun 20 at or near the full operating pressure of roughly 3000 psi. The unloader valve 16 does so by opening up a line of fluid communication between the inlet and outlet sides of the cylinders such that the water within the pump head is forced to circulate therewithin by virtue of the cylinders which remain pumping when the trigger is released. This continual circulation of water within the pump head is problematic from the standpoint of overheating because the water has no outlet from the pump head during the period when the unloader valve 16 is activated, and thereby successively increasing the temperature of the water as the pump 10 continues to churn a high rate of speed. This increase in the temperature of the water, in turn, causes the packings of the pump 10 to increase in temperature which may damage the structural integrity of the packings to a point where the pump 10 is no longer operable.

A need therefor exists for an apparatus for improving the priming of a suction-fed hydraulic pump. More particularly, an apparatus is needed for improving the degree to which a suction-fed hydraulic pump is capable of creating suction force to draw water from a holding tank to displace the air from within the suction hose and the pump to thereby prime the pump. The apparatus should be able to reduce the degree to which the volume of air within the downstream line of the pumping system presents resistance for the pump when it attempts to draw water from the holding tank to displace the air from suction hose and the pump. Specifically, the apparatus should be able to accomplish the aforementioned task of priming a suction-fed hydraulic pump regardless of the length of the connecting hose or the amount air disposed within the upstream line, the downstream line, and/or the pump by providing an escape outlet for air trapped within the complete fluid path. A need also exists for an apparatus for priming a suction-fed hydraulic pump which does not require a user to frequently trigger the spray gun in order to create an escape outlet for the air trapped within the upstream line of the pumping application, thereby decreasing the time that is required to bring the pump into a fully primed condition with the suction hose and the pump completely filled with water. Finally, a need exists for a suction-fed hydraulic pumping arrangement which provides a temperature dissipation feature so as to eliminate the undesirable and potentially damaging heating that may result when the unloader valve is activated such that the packings and pump head are more readily maintained at moderate temperatures to thereby increase the effective life span of the pump.

OBJECTS AND SUMMARY OF THE INVENTION

Accordingly, it is a primary object of the present invention to produce an apparatus for priming a suction-fed hydraulic pump which improves the degree to which a suction-fed hydraulic pump is capable of creating suction force to draw water from a holding tank to purge the air from within the suction hose and the pump to thereby prime the pump.

It is a still further object of the present invention to provide an apparatus for priming a suction-fed hydraulic pump which provides an escape route which serves as a path of least resistance for the air disposed within the pump at start-up before automatically shutting off when the pump has been primed.

It is yet another object of the present invention to provide an apparatus which can prime a suction-fed hydraulic pump regardless of the length of the connecting hose or the amount air disposed within the upstream line, the downstream line, and/or the pump by providing an escape outlet for air trapped within the complete fluid path.

It is a further object of the present invention to provide an apparatus which is capable of priming a suction-fed hydraulic pump regardless of the operating speed and displacement of the hydraulic pump.

It is yet another object of the present invention to provide an apparatus for priming a suction-fed hydraulic pump which does not require a user to frequently trigger the spray gun in order to create an escape outlet for the air trapped within the downstream line of the pumping application.

It is still a further object of the present invention to provide an apparatus which provides a temperature dissipation feature so as to eliminate any undesirable and damaging heating that may result when an unloader valve is activated such that the packings and pump head are more readily maintained at moderate temperature to thereby increase the effective life span of the pump.

In a broad aspect of the present invention, the aforementioned objects may be accomplished by providing a valve for automatically priming a pump, the valve providing an escape route for the air disposed within the pump at start-up before automatically closing when fluid has been drawn into the pump, wherein the valve comprises a housing member, a poppet member, sealing means, and biasing means. The housing member has a first end, a second end, a bore extending between first and second ends to define an inlet aperture in the first end and an outlet aperture in the second end, and a shoulder member extending radially inward from the inlet aperture, the bore including a first annular seat and a second annular seat, the shoulder member having at least one by-pass slot formed therein, the inlet aperture disposed in communication with an outlet port of the pump. The poppet member is disposed within the bore, the poppet member having a first engagement surface and a second engagement surface. The sealing means have a first engagement surface and a second engagement surface, the first engagement surface being disposed in facing relationship with the second engagement surface of the poppet member, the second engagement surface being disposed in contact with the first annular seat of the bore. The biasing means have a first end and a second end, the first end being disposed in contact with the second engagement surface of the poppet member, the second end being disposed in contact with the second annular seat of the bore. The biasing means biases the poppet member between a priming mode, wherein the first engagement surface of the poppet member is disposed in contact with the shoulder member of the housing member such that a path of fluid communication extends between the inlet aperture and the outlet aperture, and a closed mode, wherein the second engagement surface of the poppet member is disposed in contact with the first engagement surface of the sealing means such that the path of fluid communication is closed.

In yet another broad aspsect of the present invention, a valve for automatically priming a suction-fed pump is provided, the pump comprising a pump head having an inlet port and an outlet port, the valve providing an escape route for the air disposed within the pump at start-up before automatically closing when the pump has been primed. The valve comprises a housing member, a poppet member, biasing means, and sealing means. The housing member has a first end, a second end, a bore extending between the first and second ends to define an inlet aperture in the first end and an outlet aperture in the second end, and an annular shoulder member extending radially inward from the inlet aperture, the shoulder member having a by-pass slot formed therein, the housing member being mounted to the pump such that the inlet aperture is disposed in fluid communication with the outlet port of the pump head. The sealing means has a first engagement surface and a second engagement surface, the sealing means being disposed within the bore such that the second engagement surface is in contact with a first annular seat. The poppet member includes a disc portion having a first engagement surface, a second engagement surface, and a diameter generally less than the diameter of the valve portion of the bore such that a priming aperture is formed between the disc portion, the bore, and the by-pass slot when the first engagement surface of the disc portion is disposed in contact with the shoulder member. The biasing means extends between the second engagement surface of the disc portion and a second annular seat, wherein the biasing means is capable of resiliently biasing the first engagement surface of the disc portion into contact with the shoulder member when the pressure within the pump head is below a predetermined threshold such that fluid within the pump head will flow through the priming aperture and out the outlet aperture, and wherein the biasing means is capable of yielding when the pressure within the pump head exceeds the predetermined threshold so as to position the second engagement surface of the disc portion of the poppet member in contact with the first engagement surface of the sealing means such that fluid within the pump head cannot flow out the outlet aperture.

In still another broad aspect of the present invention, an improved suction-fed pumping system is provided comprising a pump, a holding tank, a suction hose, an automatic priming valve, and fluid transmission means. The pump has a pump head with an inlet port and an outlet port. The holding tank has a supply of fluid disposed therein. The suction hose has a first end connected to the inlet port of the pump head and a second end disposed within the fluid within the holding tank. The automatic priming valve has an inlet port disposed in communication with the outlet port of the pump head and an outlet port, the automatic priming valve being capable of opening to create an escape path for removing the air disposed within the suction hose and the pump head when the pump is initially started and automatically closing when the pressure within the pump head exceeds a predetermined threshold. The fluid transmission means is connected to the outlet port of the pump head for dispensing the fluid drawn from the holding tank.

DETAILED DESCRIPTION OF THE PREFERRED EMBODIMENTS

Figure 1:
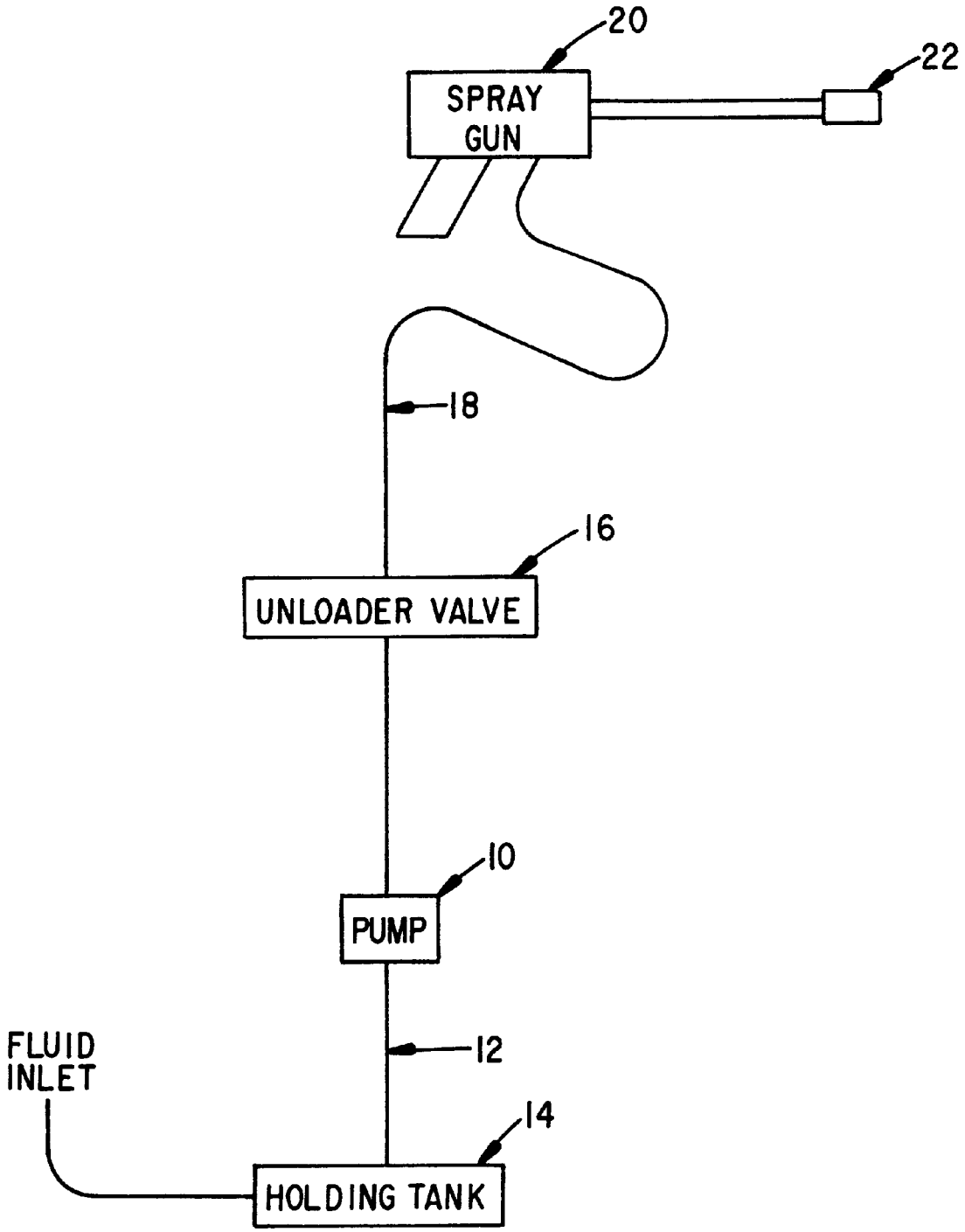
FIG. 1 (PRIOR ART)
FIG. 1 is a schematic diagram of a prior art suction-fed hydraulic pumping application.
Figure 2:
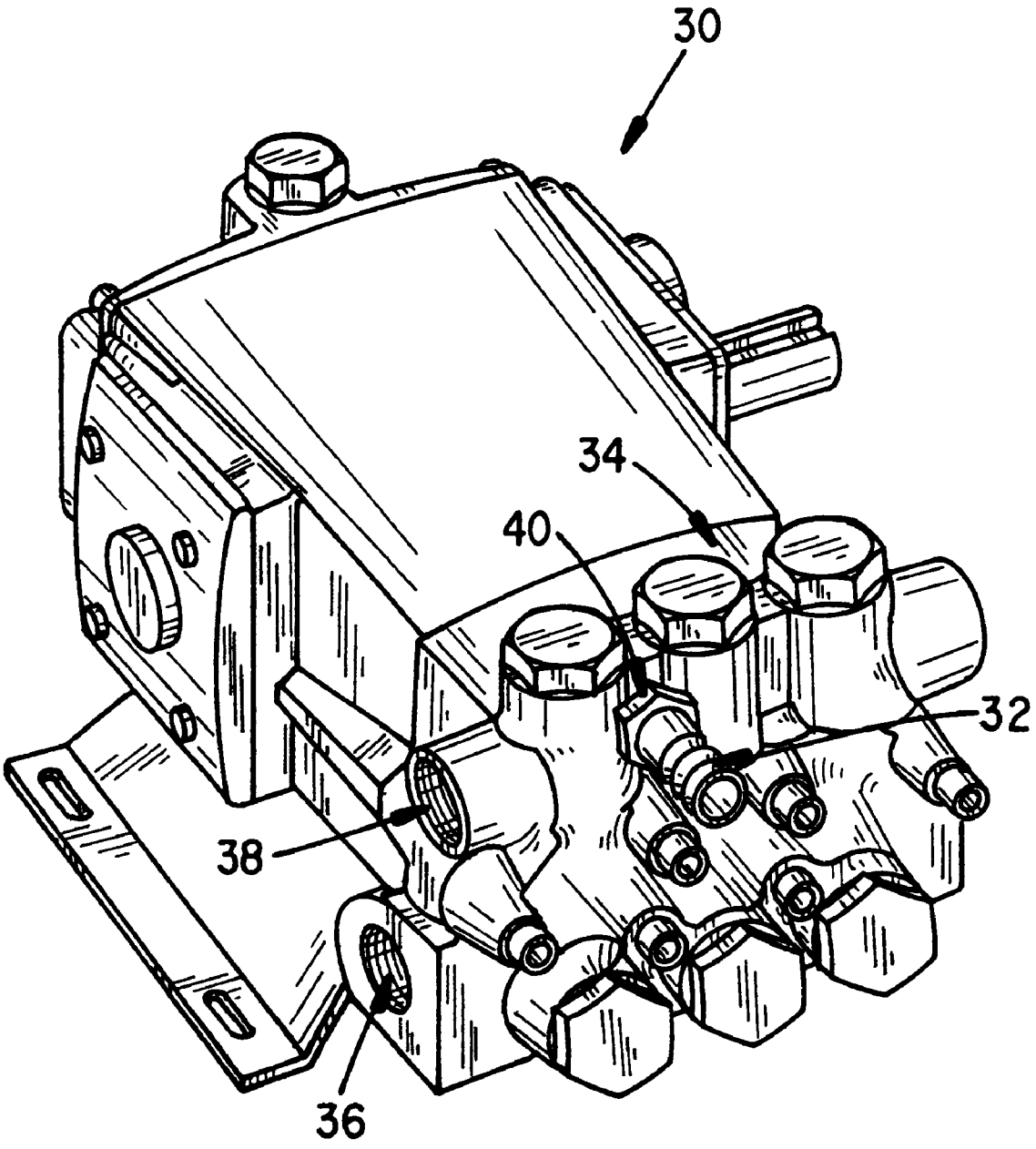
FIG. 2 is a perspective view of a three cylinder hydraulic pump 30 having an automatic priming valve 32 of the present invention disposed in fluid communication with an outlet port 38 thereof.

Referring initially to FIG. 2, shown in perspective is a multi-cylinder hydraulic pump 30 having an automatic priming valve 32 of the present invention engagedly coupled within a head member 34 of the pump 30. In the embodiment shown, the pump 30 is a three cylinder plunger pump wherein the head member 34 has a fluid inlet line 36 for directing fluid inward toward internally disposed pumping cylinders (not shown) and a fluid outlet line 38 for directing fluid outward from the internally disposed pumping cylinders (not shown). The automatic priming valve 32 is threadedly disposed within a priming port 40 formed within the head member 34, wherein the priming port 40 is in fluid communication with the fluid outlet line 38 of the pump 30. While the pump 30 is shown as a three cylinder plunger pump in FIG. 1, it is to be understood that the automatic priming valve 32 of the present invention may be similarly employed within any number of hydraulic pumps, including but not limited to duplex (two cylinder) pumps and triplex (three cylinder) pumps. One such hydraulic pump for use with the present invention is disclosed in U.S. Pat. No. 4,498,372, the teachings of which are incorporated herein by reference.

Figure 3:
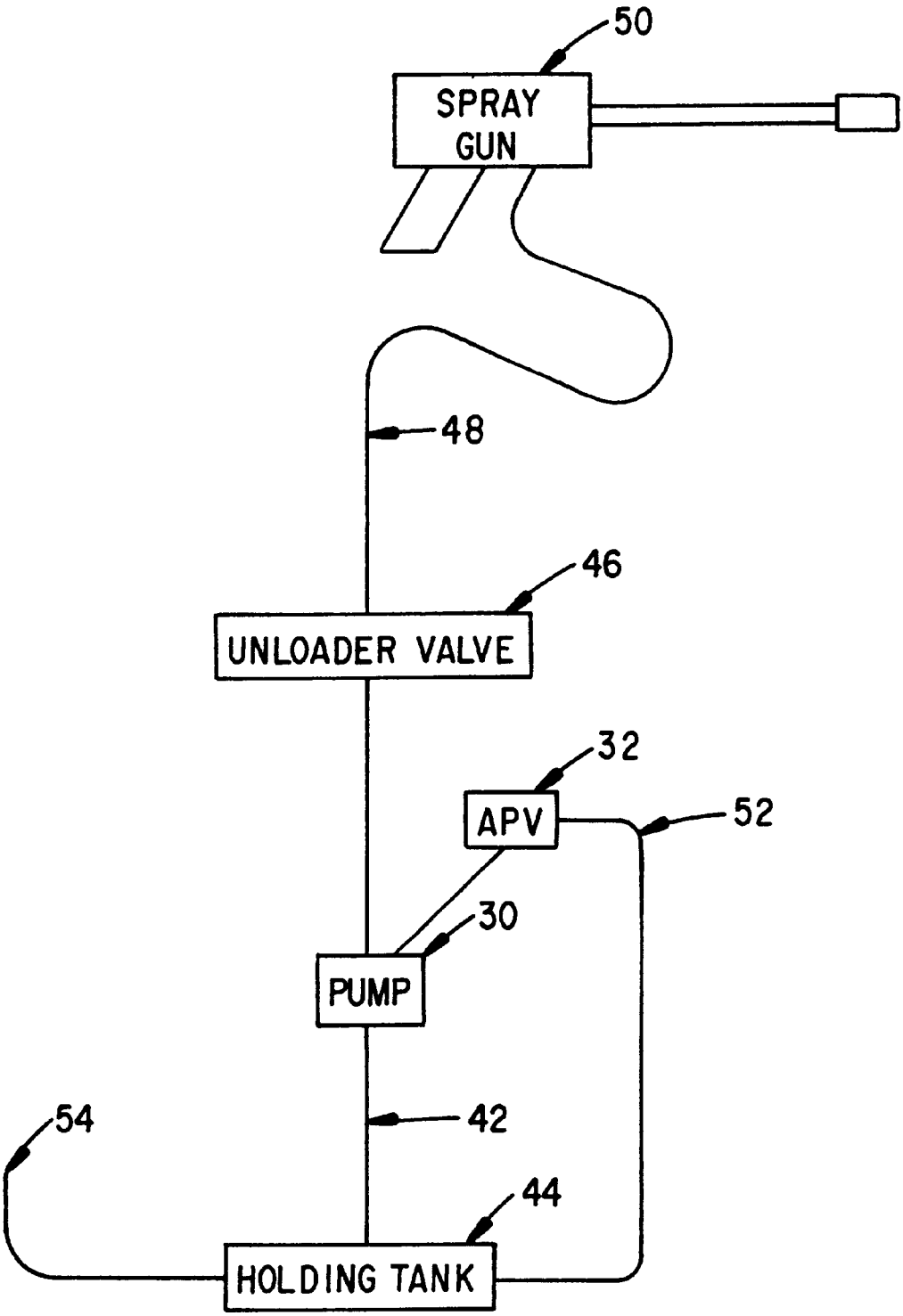
FIG. 3 is a schematic diagram of the automatic priming valve 32 of the present invention in use in a typical suction-fed hydraulic pumping application.

Referring now to FIG. 3, shown is the automatic priming valve 32 of the present invention disposed within a suction-fed high pressure spraying application. In general, the pumping system includes a hydraulic pump 30, a suction hose 42, a holding tank 44, an unloader valve 46, a connecting hose 48, a spray gun 50, an automatic priming valve (APV) 32, and a return hose 52. The suction hose 42 has a first end connected to the inlet port of the pump 30 and a second end is positioned to extend below the water line within the holding tank 44. The holding tank 44 is fed with a supply of pressurized water from a public water utility through a water supply line 54. The unloader valve 46 has a first end connected in fluid communication with the outlet port of the pump 30 and a second end connected to a first end of the connecting hose 48. The connecting hose 48 has a second end which is connected to the spray gun 50. The spray gun 50 has a nozzle of reduced diameter for producing back pressure within the connecting hose 48 when fluid is propagated from the pump 30 to the spray gun 50. The automatic priming valve 32 of a preferred embodiment of the present invention has a first end connected in fluid communication with the outlet port of the pump 30 and a second end connected to a first end of the return hose 52. The second end of the return hose 52 is connected to the holding tank 44.

Prior to starting the pump 30, the entire system shown in FIG. 3 is generally filled with air, with the exception of the holding tank 44. In order to prepare the pump 30 to spray high pressure fluid from the spray gun 50, it is first necessary to remove all the air from within the suction line 42, the pump 30, the unloader valve 46, the connecting hose 48, and the spray gun 50. The first step in accomplishing this is to prime the pump 30 by drawing water from the holding tank 44 into the suction hose 42 and pump 30 in an amount sufficient to remove the air from within the suction hose 42 and pump 30. This is a formidable task when dealing with hydraulic pumps because, as noted above, the displacement of each particular cylinder of the pump 30 is typically quite small and the pumps typically run at very high such that it is particularly difficult to draw the air out of the suction hose in order to prime the pump 30. In addition, the air trapped within the unloader valve 46, the connecting hose 48, and the spray gun 50 presents a substantial volume of air which must be pushed out of the system in order to draw water from the holding tank 44 to prime the pump 30.

The automatic priming valve 32 of the present invention solves this problem by providing an alternate route for the air to escape from within the pump 30 and the suction hose 42, thereby allowing the pump 30 to draw fluid from the holding tank 44 without having to displace the large volume of air from within the unloader valve 46, the connecting hose 48, and the spray gun 50. In other words, the automatic priming valve 32 of the present invention effectively presents a path of least resistance which extends between the outlet port of the pump 30 and the holding tank 44 such that the pump 30 may be primed in a quick and efficient manner without regard to the volume of air disposed within the unloader valve 46, the connecting hose 48, and the spray gun 50. As will be set forth below, the feature of proving a path of least resistance relative to the downstream line of the pump 30 also allows the automatic priming valve 32 of the present invention to prime the pump 30 without the need to frequently trigger the spray gun which advantageously saves time and money in priming the pump 30.

Figure 4:
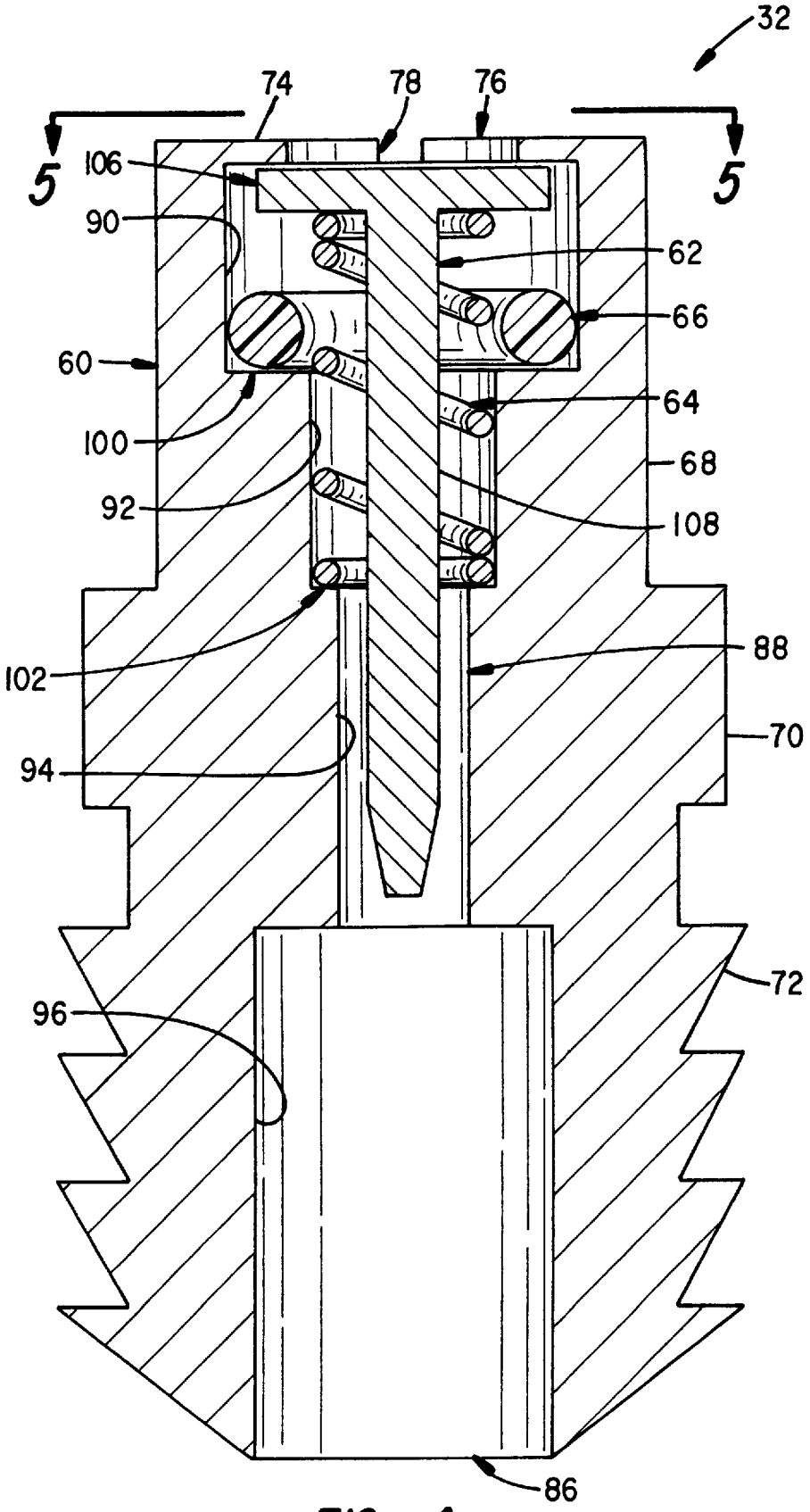
FIG. 4 is a cross sectional view illustrating the automatic priming valve 32 of the present invention in the open position for bleeding air from within the suction hose 42 and the pump 30.
Figure 5:
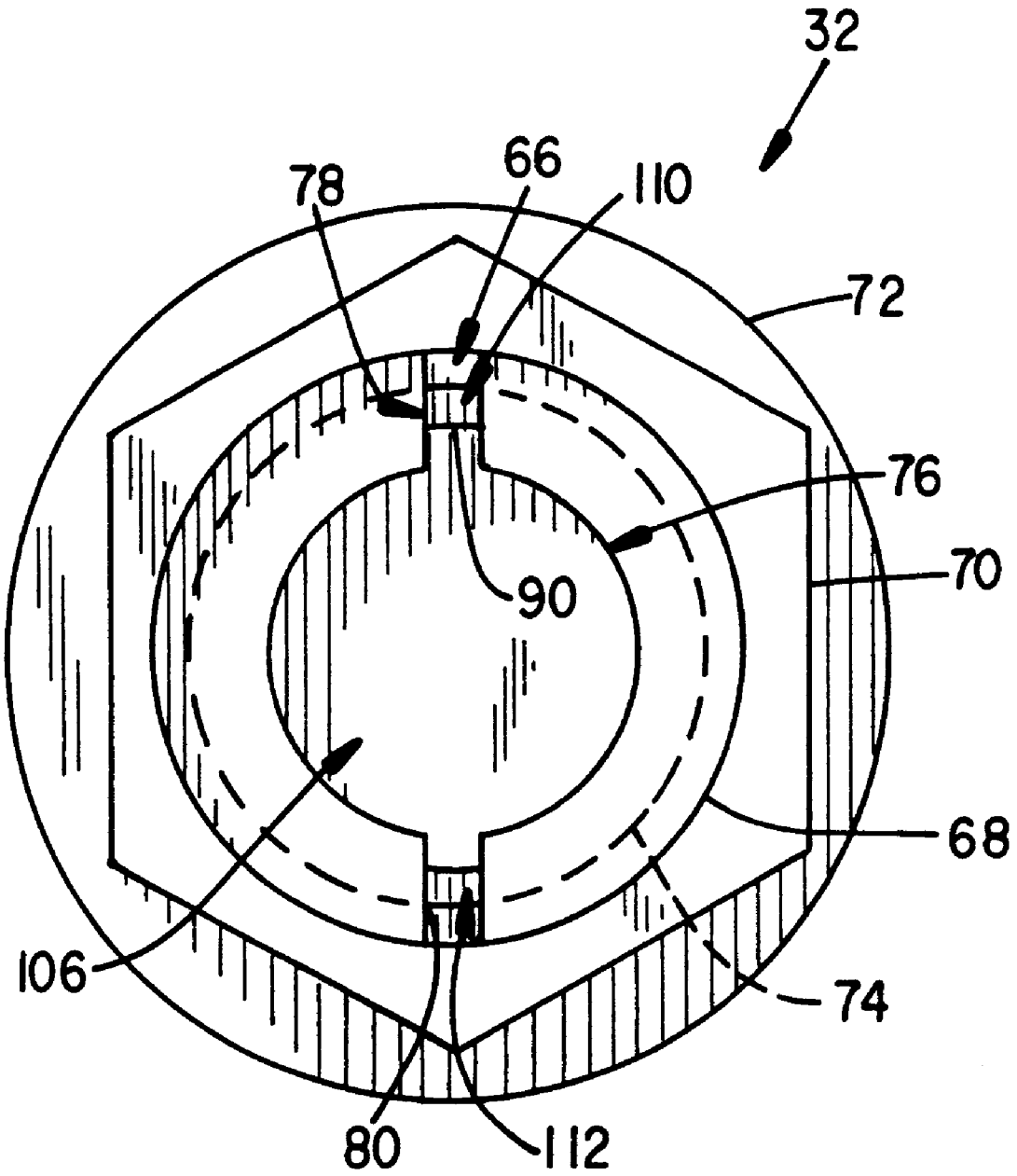
FIG. 5 is a top plan view of the automatic priming valve 32 of the present invention taken along lines 5—5 of FIG. 4.
Figure 6:
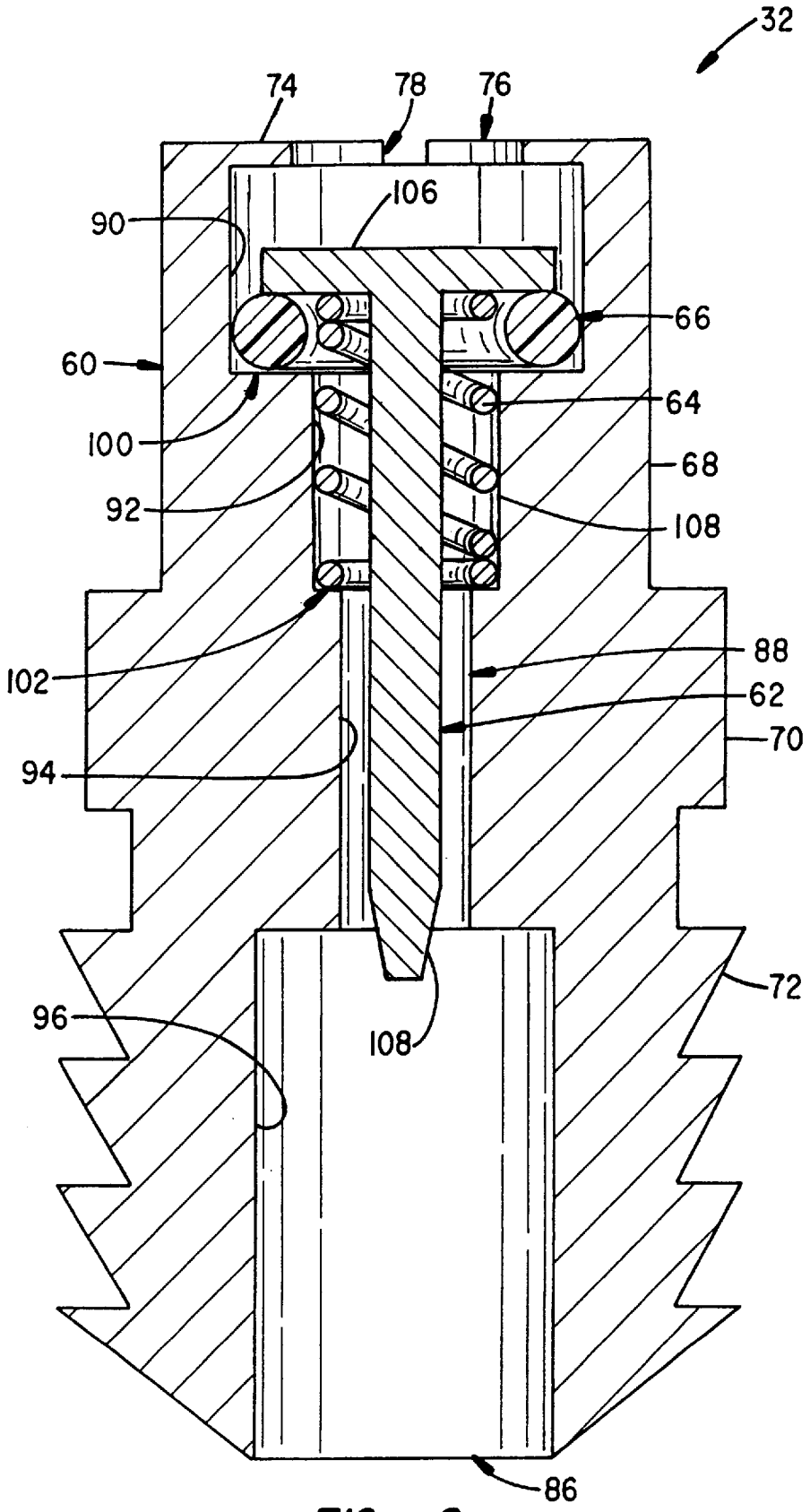
FIG. 6 is a cross sectional view illustrating the automatic priming valve 32 of the present invention in the closed position for forcing water out the outlet line of the pump 30 after the pump 30 has been primed.

Referring now to FIGS. 4–6, the automatic priming valve 32 of the present invention accomplishes the removal of the air from within suction hose 42 and the pump 30 by providing a housing member 60, a poppet member 62, a biasing spring 64, and an O-ring 66. The exterior surface of the housing member 60 includes a threaded engagement portion 68, a hex nut portion 70, and a barbed nipple portion 72. The threaded engagement portion 68 and the hex nut portion 70 are provided for facilitating the threaded engagement of the automatic priming valve 32 within the priming port 40 of the head member 34, as indicated generally in FIG. 2. The barbed nipple portion 72 is provided to receive the first end of the return hose 52 shown in FIG. 3. A shoulder member 74 extends radially inward from the threaded engagement portion 68 of the housing member 60 to define an inlet aperture 76 therewithin. A first by-pass slot 78 and a second by-pass slot 80 are provided within the shoulder member 74 to allow air to flow from the inlet aperture 76 to an outlet aperture 86 when the automatic priming valve 32 of the present invention is in a priming mode of operation shown in FIGS. 4 and 5.

The housing member 60 also includes a cylindrical bore, indicated generally at 88, which extends concentrically within the housing member 60 between the inlet aperture 76 and the outlet aperture 86. As can be seen, the concentrically disposed cylindrical bore 88 includes a valve portion 90, a poppet biasing portion 92, a poppet guiding portion 94, and a return hose supply portion 96, wherein each portion has a generally uniform diameter. The valve portion 90 extends between the shoulder member 74 and an O-ring seat 100. The poppet biasing portion 92 has a smaller diameter than the valve portion 90 and extends between the O-ring seat 100 and a spring seat 102. The poppet guiding portion 94 has a smaller diameter than the poppet biasing portion 92 and extends between the spring seat 102 and the approximate point at which the individual barbs extend from the barbed nipple portion 72. The return hose supply portion 96 has a diameter in between that of the valve portion 90 and the poppet biasing portion 92 and extends between the poppet guiding portion 94 and the outlet aperture 86. The housing member 60 of the present invention is preferably constructed from brass or other suitable metals or high density plastic capable of withstanding working pressures in excess of 3000 psi.

The poppet member 62 is generally concentrically disposed within the housing member 60 and comprises a generally planar disc portion 106 and a generally cylindrical stem portion 108 extending perpendicularly from the disc portion 106. The poppet member 62 may be constructed from any number of suitable materials, including but not limited to brass or high density plastic. The O-ring 66 is positioned in contact with the O-ring seat 100 and dimensioned so as to have an outer diameter that is generally equal to the inner diameter of the valve portion 90 of the cylindrical bore 88 and an inner diameter that is slightly greater than the outer diameter of the spring member 64. The O-ring 66 is preferably constructed from Buna or similar rubber materials. The spring member 64 is disposed between the spring seat 102 and a lower surface of the disc portion 106 and has an outer diameter that is generally equal to the inner diameter of the poppet biasing portion 92 of the cylindrical bore 88. The spring member 64 is preferably constructed from any suitable metal material, but may also be comprised of suitably resilient plastic compositions.

Referring now to FIGS. 4 and 5, illustrated is the automatic priming valve 32 of the present invention in the priming mode of operation. In general, the priming mode of operation extends between the time that the pump 30 is turned on and the time that fluid has been introduced into the suction hose 42 and the pump 30 in an amount sufficient to remove substantially all the air from within the suction hose 42 and pump 30. During this period, the spring member 64 is biased to force the upper surface of the poppet member 62 into contact with the lower surface of the shoulder member 74. With particular reference to FIG. 5, the first and second by-pass slots 78, 80 extend between the outer diameter of the shoulder member 74 and the inner diameter of the shoulder member 74 so as to define a first priming aperture 110 and a second priming aperture 112. The first and second priming apertures 110, 112 extend laterally between the first and second by-pass slots 78, 80 and radially between the disc portion 106 of the poppet member 62 and the inner diameter of the valve portion 90 of the cylindrical bore 88.

Advantageously, the first and second priming apertures 110, 112 allow air to pass between the inlet aperture 76 and the outlet aperture 86 when the pump 30 is initially turned on. This is extremely important to the priming feature of the present invention in that, by providing fluid communication between the inlet aperture 76 and the outlet aperture 86, the automatic priming valve 32 provides an escape outlet for the air which is initially disposed within the suction hose 42 and the pump 30 at start-up. As such, the pump 30 may quickly and easily draw fluid from within the holding tank 44 because the pump 30 does not need to displace any of the air that resides within the downstream components of the pumping system, namely the unloader valve 46, the connecting hose 48, and the spray gun 50. Instead, the inlet aperture 76 of the automatic priming valve 32 is disposed in fluid communication with the outlet line of the pump 30 such that the air originally disposed within the suction hose 42 and the pump 30 is progressively forced through the first and second priming apertures 110, 112, the valve portion 90, the poppet biasing portion 92, and the poppet guiding portion 94 before exiting the outlet aperture 86. Equipped with the automatic priming valve 32 of the present invention, the pump 30 is capable of reaching a fully primed condition in approximately 7 to 8 seconds from the time the pump 30 is started. Thus, the automatic priming valve 32 of the present invention drastically reduces the amount of time required to prime a suction-fed pump of the type shown in FIG. 1 which, as noted above, may take as much as 20 minutes to prime if it actually reaches a fully primed state.

In a preferred embodiment of the present invention, the return hose 52 illustrated in FIG. 3 is attached to the end of the barbed nipple member 72 so as to establish a line of fluid communication between the automatic priming valve 32 and the holding tank 44. The return hose 52 is provided to manage the air and any fluid that is expelled from the outlet aperture 86 of the automatic priming valve 32 during the priming mode of operation. To further explain, fluid will be drawn from the holding tank 44 into the suction hose 42 and the pump 30 in a progressive fashion during the priming stage such that slugs of air and fluid will be successively expelled from the outlet aperture 86 of the automatic priming valve 32. As will be explained in greater detail below, the spring member 64 is equipped with a predetermined spring constant such that the poppet member 62 can withstand the impact of the fluid during the intermittent passage of air and water during the priming stage. Moreover, the spring member 64 is designed to allow the poppet member 62 to yield under the pressure of the incoming water when the amount of air within the suction hose 42 and pump 30 drops to a point where the pump 30 is fully primed with fluid within the suction hose 42 and the pump 30. Prior to the instance when the pump 30 is fully primed, the return hose 42 effectively re-routes the air and any fluid that is drawn through the suction hose 42 and the pump 30 back into the holding tank 44 such that this air and water will not spray about the pumping area during the priming of the pump.

Referring now to FIG. 6, the automatic priming valve 32 of the present invention is illustrated in the closed mode, wherein the poppet member 62 is forced into contact with the O-ring 66 by the fluid which has been drawn into the pump 30 so as to effectively cut off the fluid communication between the inlet aperture 76 and the outlet aperture 86. With the automatic priming valve 32 in the closed condition shown, the fluid that has been drawn into the suction hose 42 and the pump 30 can no longer pass through the cylindrical bore 88 for passage through the return line 52 back into the holding tank 44. As such, the only passage that remains available to the fluid within the pump 30 is the downstream line comprising the unloader valve 46, the connecting hose 48, and the spray gun 50. The spray gun 50 is then capable of engaging in the high pressure spraying applications. In this fashion, then, the automatic priming valve 32 of the present invention is capable of sensing the difference between fluid and air such that the air disposed within the pump at start-up may be quickly and efficiently bled from the system before the valve automatically closes once fluid has been drawn into the pump in an amount sufficient to bring the pump into a fully primed condition.

In an important aspect of the present invention, this entire priming process does not require a user to manually trigger the spray gun 50 to allow an escape outlet for the air trapped within the unloader valve 46, the connecting hose 48, and spray gun 50 at start-up. Instead, the automatic priming valve 32 of the present invention is capable of simply and quickly priming a hydraulic pump in a completely automatic fashion with no user interaction needed. This is because the automatic priming valve 32 vacillates between the priming mode shown in FIGS. 4 and 5 until a predetermined fluid pressure develops within the pump 30, after which point the automatic priming valve 32 automatically enters the closed mode shown in FIG. 6 to enable the spray gun 50 for operation. In a preferred embodiment of the present invention, the predetermined water pressure which will overcome the spring member 64 to close the poppet member 62 into the O-ring 66 is approximately 100 psi. However, the resiliency of the spring member 64 may be modified as needed to suit the needs of the particular application to ensure that, regardless of the type of fluid or pump employed, the spring member 64 can maintain the poppet member 62 in the priming mode shown in FIGS. 4 and 5 long enough to bleed the air from within the suction hose 42 and the pump 30 to prime the pump 30.

The automatic priming valve 32 of the present invention offers yet another significant advantage over the prior art in that the automatic priming valve 32 has the ability to reduce the temperatures that developments within the pump head when the unloader valve 46 is activated following the release of the spray gun trigger. As noted above, the unloader valve 46 acts to reduce the pressure within the pump head when the trigger of the spray gun 50 is released by opening up a line of fluid communication between the inlet and outlet sides of the cylinders such that the water within the pump head is forced to circulate therewithin by virtue of the cylinders which remain pumping when the trigger is released. This causes the fluid within the pump head to heat up which, in turn, may cause the packings of the pump 30 to cook and become damaged. The present invention solves this problem of overheating within the pump head by allowing the poppet member 62 to return to the priming mode shown in FIGS. 4 and 5 when the unloader is activated. To be more specific, the poppet member 62 will return to the flush position against the shoulder member 74 because the pressure within the pump 30 will drop to a point at or near 0 psi when the unloader valve 46 is activated. When the pressure drops within the pump 30, the spring member 64 is then the largest and most overwhelming force acting upon the poppet member 62 so as to drive the disc portion 106 of the poppet member 62 into contact with the shoulder member 74. In this position, the first and second priming apertures 110, 112 are once again established so as to provide fluid communication between the inlet aperture 76 and the outlet aperture 86 of the automatic priming valve 32.

This is extremely important to the temperature reducing feature of the present invention in that, by providing fluid communication between the inlet aperture 76 and the outlet aperture 86, the automatic priming valve 32 provides an escape outlet for the fluid which circulates within the pump head when the unloader valve 46 is activated. The continued pumping of the cylinders within the pump head during this time creates a slight internal pressure within the pump head which forces the circulating fluid to be pass through the first and second priming apertures 110, 112 for eventual expulsion from the outlet aperture 86 of the automatic priming valve 32 and back into holding tank 44 by virtue of the return hose 52. In an important aspect of the present invention, the expulsion of circulating fluid from within the pump head causes fluid to be drawn from the suction hose 42 into the pump 30. This new fluid that is drawn into the pump 30 is typically much cooler in temperature than the fluid which is expelled from the pump head 34. As such, the present invention allows cool fluid to replace the hotter fluid within the pump head such that the overall temperatures within the pump head are substantially reduced. This, of course, translates into less wear on the pump 30 which can extend to the useful life of the pump 30, thus reducing costs. The automatic priming valve 32 of the present invention is also advantageous in that it automatically indicates when the pump 30 is primed by closing the poppet member 62 against the O-ring 66, thereby eliminating the need for pressure gauges within the pumping system.

From the foregoing it should now be recognized that an improved apparatus has been advantageously provided herein for automatically and quickly priming a hydraulic pump during a suction-fed application. The automatic priming valve of the present invention has a simple and low cost design. The automatic priming valve of the present invention improves the degree to which a suction-fed hydraulic pump is capable of creating suction force to draw fluid from a holding tank to displace the air from within the suction hose and the pump. Furthermore, the automatic priming valve is capable of creating a path of least resistance for the air disposed within the pump at start-up, thereby reducing the degree to which the volume of air within the downstream line of the pumping system presents resistance for the pump when it attempts to draw fluid from the holding tank to displace the air from suction hose and the pump. The present invention is capable of priming a suction-fed hydraulic pump regardless of the length of the connecting hose or the amount air disposed within the upstream line, the downstream line, and/or the pump by providing an escape outlet for air trapped within the upstream line and the pump. Moreover, the present invention is fully automatic and does not require the use of a manual by-pass valve or a user to trigger the spray gun in order facilitate the priming of the pump. The present invention also provides a temperature dissipation feature so as to eliminate any undesirable and damaging heating that may result when an unloader valve is activated such that the packings and pump head are more readily maintained at moderate temperature to thereby increase the effective life span of the pump. Importantly, the present invention drastically reduces the amount of time required to bring a suctionfed hydraulic pump into fully primed condition, thereby reducing the degree to which the pump is subjected to stress and heating from "dry pumping" with no fluid in the cylinders.

The preferred apparatus embodiments depicted herein are exemplary and numerous modifications, dimensional variations, and rearrangements can be readily envisioned to achieve an equivalent result, all of which are intended to be embraced within the scope of the appended claims.

What is claimed is:

1. An improved suction-fed pumping system, comprising:

a pump having a pump head with an inlet port and an outlet port;

a holding tank having a supply of fluid disposed therein;

a suction hose having a first end connected to said inlet port of said pump head and a second end disposed within said fluid of said holding tank;

an automatic priming valve with a housing member having a first end, a second end, and an inlet aperture formed in said first end, an outlet aperture formed in said second end, a bore extending between said input aperture and said outlet aperture, and a shoulder member extending radially inward from said first end, said bore including a first annular seat and a second annular seat, said shoulder member having at least one by-pass slot formed therein and with a poppet member disposed within said bore, said poppet member having a first engagement surface and a second engagement surface and a sealing means having a first engagement surface and a second engagement surface, said first engagement surface being disposed in facing relationship with the second engagement surface of the poppet member, the second engagement surface being disposed in contact with said first annular seat of the bore of the housing member and further including a biasing means having a first end and a second end, the first end of the biasing means being disposed in contact with the second engagement surface of the poppet member, the second end of the biasing means being disposed in contact with the second annular seat or the bore of the housing member, the inlet aperture of the housing member disposed in communication with the outlet port of the pump head, and with the biasing means biasing the poppet member between a priming mode wherein the first engagement surface of the poppet member is disposed in contact with said shoulder member of the housing member, creating a fluid path extending between the inlet aperture and the outlet aperture, and a closed mode wherein the second engagement surface of the poppet member is disposed in contact with the first engagement surface of the sealing means such that the fluid path is closed; and fluid transmission means connected to the outlet port of the pump head for dispensing fluid drawn from the holding tank, said fluid transmission means including an unloader valve, a connecting hose and a spray gun, the unloader valve having a first end connected to the outlet port of the pump head and the second end connected to a first end of the connecting hose, the connecting hose having a second end connected to the spray gun, whereby the automatic priming valve allows fluid to pass through the escape path when the unloader is activated so as to allow fresh fluid to be drawn into the pump head to hereby reduce the temperature within the pump head when the unloader valve is activated.

2. The improved suction-fed pumping system as set forth in claim 1 and further, comprising a return hose having a first end connected to said outlet aperture of said housing member and a second end disposed within said holding tank.

* * * * *